United States Patent [19]

Lyman

[11] 4,289,484

[45] Sep. 15, 1981

[54] CAR BOTTOM FURNACE

[75] Inventor: Lawrence C. Lyman, Broadbrook, Conn.

[73] Assignee: Industronics, Inc., South Windsor, Conn.

[21] Appl. No.: 109,927

[22] Filed: Jan. 7, 1980

[51] Int. Cl.[3] ..... F27D 3/12

[52] U.S. Cl. ..... 432/241; 34/242; 432/137; 432/250

[58] Field of Search ..... 432/137, 241, 242, 250; 34/242

[56] References Cited

U.S. PATENT DOCUMENTS

| | | | |
|---|---|---|---|
| 1,898,042 | 2/1933 | Forse et al. | 432/137 |
| 2,085,254 | 6/1937 | Emery | 432/241 |
| 2,899,189 | 8/1959 | Matis et al. | 34/242 |
| 4,183,305 | 1/1980 | Payne | 432/50 |
| 4,207,066 | 6/1980 | Weldon | 432/241 |

*Primary Examiner*—John J. Camby

*Attorney, Agent, or Firm*—Prutzman, Kalb, Chilton & Alix

[57] ABSTRACT

A high temperature car bottom furnace is provided with an improved seal on the mating closing surfaces. The side walls of the furnace chamber have tapered bottom surfaces sloping toward the end wall of the furnace chamber. The moving furnace floor is provided with complementary tapered sealing surfaces mating with the bottom surfaces of the side wall. A resilient compressible insulating layer is secured therebetween for sealing the chamber along each side wall. This arrangement not only reduces the abrasive contact between the moving surface and the compressible insulating layer but also facilitates non-abrasive closing action by the door wall of the furnace.

8 Claims, 6 Drawing Figures

CAR BOTTOM FURNACE

The present invention relates generally to high temperature furnaces and is more particularly concerned with a new and improved high temperature furnace of the type employing a traveling base or floor, hereinafter referred to as a car bottom furnace.

Relatively large, high-temperature furnaces are used in a number of different industries, such as in the glass, ceramic and metallurgical industries or the like, and frequently require that the furnace be sealed during high temperature treating operations. To perform this sealing function, a resilient, heat resistant cushion, such as a layer of fiberglass or the like, is frequently secured to one of the mating surfaces. Where car bottom furnaces are used the bottom typically is sealed by a sand trough since the mating surface on the bed of the moving member engages and rubs against the sealing cushion as it moves along the entire longitudinal extent of the furnace thereby causing abrasive wear and reducing the effective operating life of the resilient sealing material.

The present invention provides a furnace construction having an improved seal on the mating surfaces of the furnace. This improved seal is achieved by reducing the amount or extent of relative abrasive movement between the mating surfaces and the sealing material. During the major portion of the mating surfaces travel toward and away from a closing and sealing position the sealing surface on the car bottom of the present invention is not in contact with the sealing material. Instead it only engages and seals the furnace chamber during a minor terminal portion of its travel. This is achieved by providing on the side walls of the furnace chamber, tapered bottom surfaces sloping toward the end wall of the furnace chamber. The moving furnace floor is provided with complementary tapered sealing surfaces for mating with the bottom surfaces of the side wall. However the moving surfaces are almost fully closed before engaging the resilient compressible insulating layer that is secured therebetween for sealing the chamber along each side wall. This arrangement not only reduces the abrasive contact between the moving surface and the compressible insulating layer but also facilitates non-abrasive closing action by the door wall of the furnace as well.

Other advantages will be in part obvious and in part pointed out more in detail hereinafter.

A better understanding of the objects, advantages, features, and relationships of the invention will be obtained from the following detailed description and accompanying drawings which set forth an illustrative embodiment and are indicative of the way in which the principles of the invention are employed.

Figure 1:
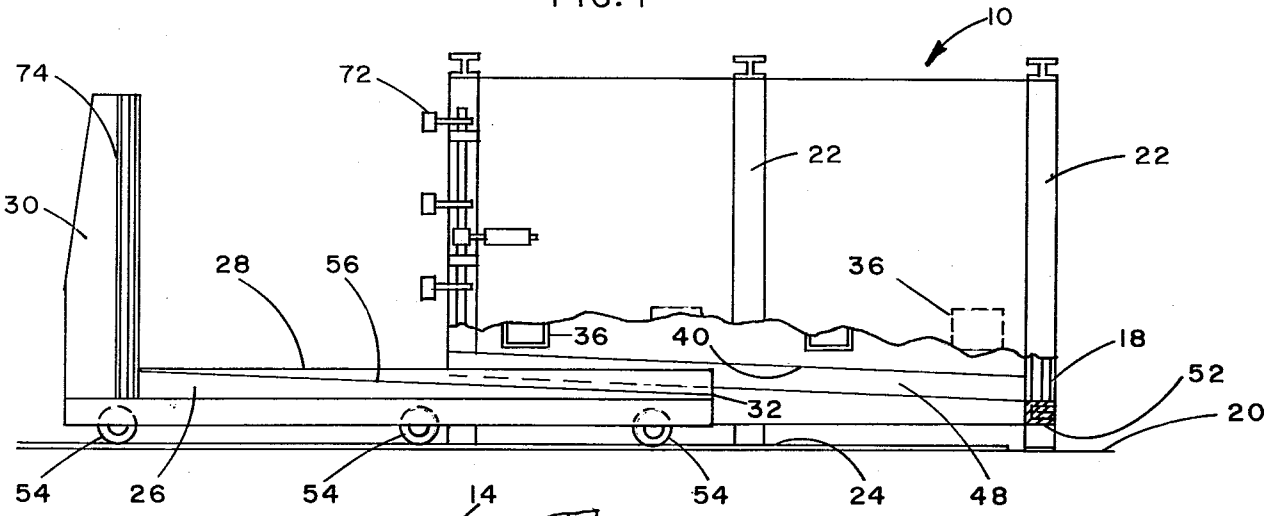
FIG. 1 is a side elevational view of a car bottom furnace incorporating the features of the present invention, the furnace being shown with the car bottom located in a partially closed position.
Figure 2:
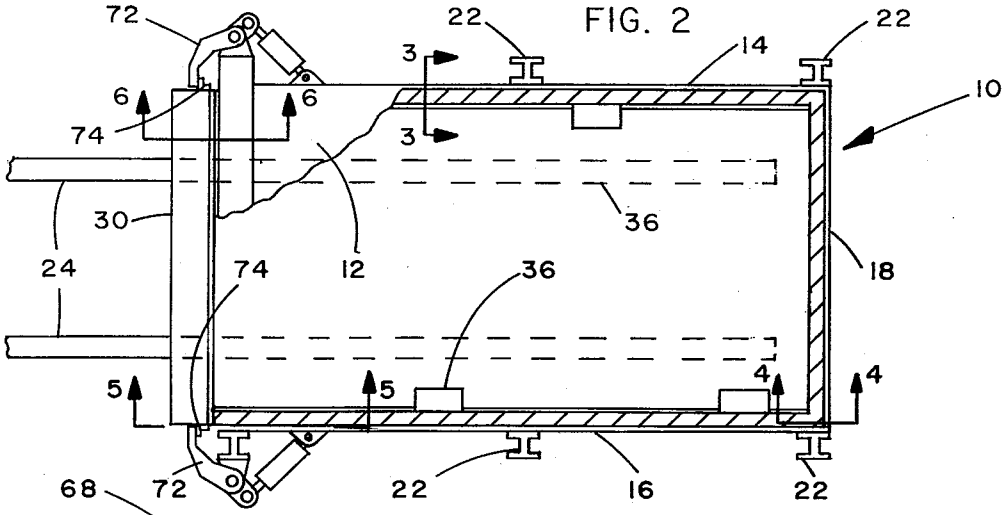
FIG. 2 is a top view of the furnace of FIG. 1, partially broken away and partially in section, showing the car bottom and door wall in their fully closed position.

Referring now to the drawings in greater detail, wherein like reference numerals indicate like parts throughout the several figures, the present invention is shown as embodied within a high temperature furnace of the gas fired type generally designated by the numeral 10. The furnace 10 is of a generally rectangular configuration having a furnace chamber defined by a ceiling 12, a pair of depending side walls 14, 16 integral with the ceiling and an integral rear wall 18, all fixedly mounted on a suitable stationary support 20 by means of appropriate supporting beams 22. The furnace chamber, that is open at its bottom and front end wall, is positioned above a rail or track 24 on which rides a car bed or platform 26 supporting a substantially flat, horizontal furnace floor 28. The car bed 26 also supports an upstanding furnace door 30 at its rearwardmost end for closing the furnace chamber when the front end 32 of the bed 26 reaches and engages the rear wall 18. As illustrated in FIGS. 1 and 2, the side walls are provided with gas burner ports and/or exhaust ports 36 for heating the furnace to a controlled high temperature condition or for introducing a suitable treating gas or other environment into the furnace chamber. The side walls, ceiling and rear wall of the chamber are all covered with a suitable high temperature resistant furnace lining material, such as the lining sold by the Carborundum Company under the Tradename "Fiberwall".

Figure 3:
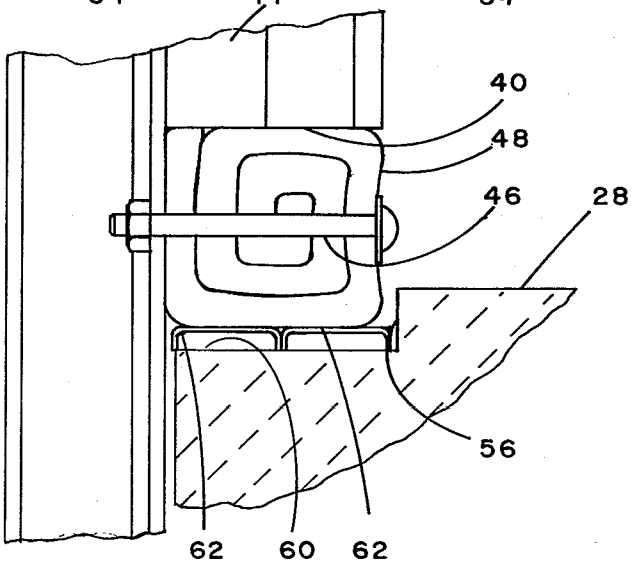
FIG. 3 is an enlarged sectional view taken along the line 3—3 of FIG. 2 illustrating the sealing relationship between the car bottom and side walls of the furnace.

In accordance with the present invention, the two side walls 14, 16 of the furnace chamber each are provided with bottom edge surfaces 40, 42 respectively that taper longitudinally downwardly toward the end wall 18. The tapered surfaces 40, 42 extend continuously along the entire length of each wall from the door opening to the end wall. Secured to these side walls along the tapered surfaces are rolled insulation blanket material anchored thereto by suitable fasteners such as the bolts 46 illustrated in FIGS. 3 and 5. These compressible rolled blanket materials are made from washed bulk fibers of inorganic composition having excellent high temperature resistant insulation qualities. Typical of such material are the compressible blankets sold by Carborundum Company under the trademark "Fiberfrax". The rolled blanket construction used as the sealing cushion is particularly advantageous since it permits compression of the blanket during the sealing operation, with the compression typically being about $1\frac{1}{2}$ to 2 inches thus assuring a positive seal for the high temperature environment of the furnace chamber. The compressible sealing blankets 48, 50 extend along the full length of their respective side walls from the door opening to the rear wall 18. A similar blanket 52 also is provided across the full transverse dimension of the back wall 18 adjacent the bottom thereof at a location where it is engageable by the front end 32 of the car bottom as it moves into its closed position.

As shown, the car bed 26 is mounted for movement toward and away from the stationary furnace chamber by means of a number of wheels 54 that support the bed for movement along the track 24. The car bed 26 is provided with a substantially flat horizontally extending furnace floor portion 28 provided along its opposite longitudinal sides with a pair of wedge shaped recesses 56 toward the front end 32 of the floor from an upstanding furnace door portion 30 located on the rear of the bed. The wedge shaped recesses are complimentary to the side walls in size and location so that as the car bed moves along the track toward a closed furnace position, the recesses are brought into underlying registry with side walls of the furnace chamber. The tapered longitudinally extending top surfaces 60 of the recesses are preferably provided with a smooth non-abrasive cap 62 such as the pair of stainless steel rails shown in FIGS. 3 and 4. Thus, as the floor 28 of the furnace is moved toward its closed position, initially there is no engagement between the stainless steel caps 62 and the sealing cushions 48, 50 affixed to the bottom edge of the side walls until the front end 32 of the floor has progressed along a major portion of its entry into the furnace chamber. Only thereafter does the stainless steel cap 62 on each tapered surface 60 carried by the floor engage its overlying cushion and compress the cushion to provide a secure and firm seal about the bottom periphery of the furnace chamber. This construction eliminates the continuous sliding contact between the floor and the sealing cushion as the floor moves into position and thereby reduces the abrasion on the blanket material forming the cushion while assuring a positive and environmentally tight seal for the chamber.

Figure 5:
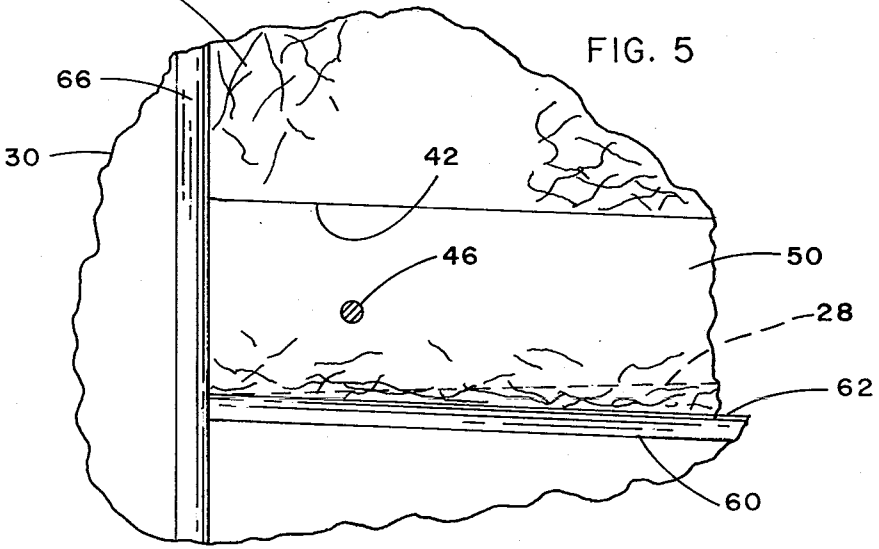
FIG. 5 is an enlarged sectional view taken along the line 5—5 of FIG. 2 illustrating the seal between the movable car bottom and door of the furnace in their closed and sealed position.
Figure 6:
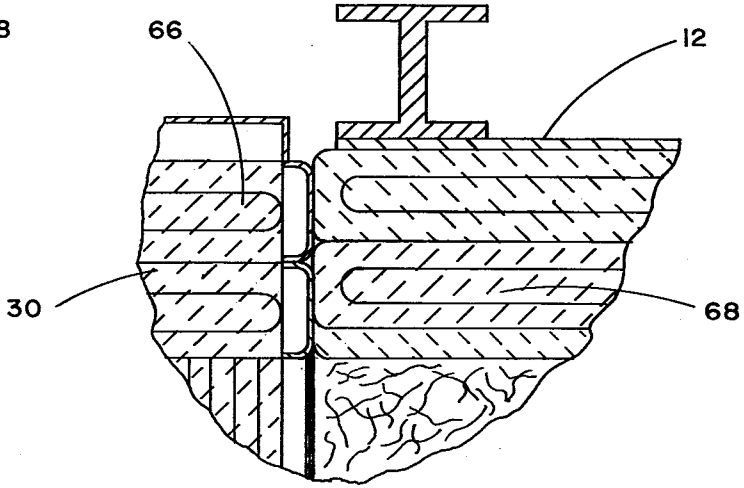
FIG. 6 is an enlarged sectional view taken along the line 6—6 of FIG. 2 illustrating the seal between the door and side wall of the furnace at the ceiling thereof.

As shown in FIGS. 5 and 6, the vertically mounted door 30 of the furnace is also provided with a high temperature resistant cushioning or sealing material 66 so that as the door simultaneously moves into its closed position, the sealing cushion 66 on the door will engage complimentary cushioning material 68 on the side walls at the door opening to provide a positive seal about the entire periphery of the door.

Figure 4:
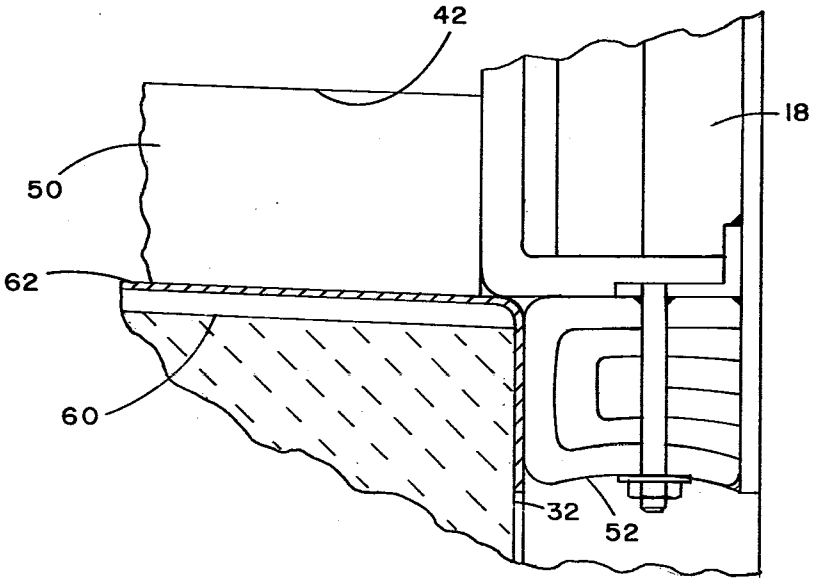
FIG. 4 is an enlarged sectional view taken along the line 4—4 of FIG. 2 illustrating the seal obtained between the car bottom and the end or rear wall of the furnace.

It will be appreciated that as the door moves into its closed position, the front end 32 of the furnace floor also reaches the rear wall 18 of the furnace and engages the high temperature resistant lining 52 affixed thereto. As best seen in FIG. 4 the stainless steel cap 62 on the side ramps of the floor extend over the front edge thereof and engage the sealing cushion 52 affixed to the bottom of the rear wall 18 so as to assure a positive seal along the back edge of the furnace and positive control of the environment within the furnace chamber.

In the furnace illustrated, there also is provided a pneumatically actuated door sealing clamp 72 on each side of the door. These clamps engage vertically extending flanges 74 on the outer periphery of the door to drive the door and furnace floor toward the rear wall and into a securely closed position with all of the sealing cushions slightly compressed.

As will be apparent to persons skilled in the art, various modifications, adaptations and variations of the foregoing specific disclosure can be made without departing from the teachings of the present invention.

I claim:

1. In a high temperature car bottom furnace having a furnace chamber including a pair of side walls and an end wall, and a car mounted furnace floor movable relative to said chamber between an open position spaced from said walls and a closed position operatively engaging said walls, the combination wherein said side walls have tapered bottom surfaces sloping toward said end wall, said surface floor has tapered sealing surfaces complementary to said bottom surfaces for mating with the bottom surfaces of the side walls to close the bottom of said furnace chamber, the sealing surfaces of said floor being in spaced confronting nonsealing relationship to said bottom surfaces during a major portion of the floor travel into its closed position, and a resilient compressible insulating layer secured to at least one of the mating surfaces along the full extent of each side wall for compressive engagement between said mating surfaces to seal said chamber along said side walls as the floor reaches its closed position.

2. The car bottom furnace of claim 1 wherein a resilient compressible insulating layer is mounted on at least one of said end wall and said floor for compressive engagement therebetween when said movable floor is in its closed position to provide a seal for said chamber along the extent of said end wall.

3. The car bottom furnace of claims 1 or 2 wherein the compressible insulating layer is a high temperature insulating fiber blanket.

4. The car bottom furnace of claim 1 wherein said floor is provided with longitudinal wedge shaped side flanges carrying said tapered sealing surfaces thereon.

5. The car bottom furnace of claim 1 or 4 wherein the tapered surfaces movable relative to said insulating layers include a smooth cap for non-abrasive surface engagement with said layers.

6. The car bottom furnace of claim 1, 2, or 4 wherein said insulating layer is a rolled ceramic fiber blanket having a transverse dimension substantially equal to the transverse dimension of the tapered surface movable relative thereto to provide a wide area seal therewith.

7. The car bottom furnace of claim 1 wherein the insulating layers are mounted on said side walls and said tapered sealing surfaces on said floor move longitudinally of said layer in spaced underlying relationship therewith prior to sealing engagement therebetween.

8. The car bottom furnace of claim 1 wherein a door wall is mounted for closing movement with said movable floor.

* * * * *